US006705295B1

(12) United States Patent
Tarroux et al.

(10) Patent No.: US 6,705,295 B1
(45) Date of Patent: Mar. 16, 2004

(54) METHOD FOR MEASURING THE FUEL PRESSURE IN AN INJECTION TRAIN OF AN INTERNAL COMBUSTION ENGINE

(75) Inventors: Francis Rene Henri Tarroux, Pinsaguel (FR); Bertrand Hauet, Saint Germain de la Grange (FR); Alain Aubourg, Saint Jean (FR)

(73) Assignees: Renault, Boulogne Billancourt (FR); Siemens Automotive S.A., Toulose (FR)

( * ) Notice: Subject to any disclaimer, the term of this patent is extended or adjusted under 35 U.S.C. 154(b) by 0 days.

(21) Appl. No.: 10/110,110

(22) PCT Filed: Oct. 6, 2000

(86) PCT No.: PCT/FR00/02778

§ 371 (c)(1),
(2), (4) Date: Aug. 6, 2002

(87) PCT Pub. No.: WO01/27454

PCT Pub. Date: Apr. 19, 2001

(30) Foreign Application Priority Data

Oct. 8, 1999 (FR) ..... 99 12573

(51) Int. Cl.[7] ..... F02D 41/38
(52) U.S. Cl. ..... 123/488; 73/119 A; 123/494
(58) Field of Search ..... 123/456, 478, 123/480, 488, 494; 73/116, 119 A

(56) References Cited

U.S. PATENT DOCUMENTS

| | | | | |
|---|---|---|---|---|
| 5,950,598 | A | 9/1999 | Wenzlawski et al. | 123/435 |
| 2002/0157646 | A1 * | 10/2002 | Hiraku et al. | 123/456 |

FOREIGN PATENT DOCUMENTS

| | | |
|---|---|---|
| DE | 197 26 756 | 1/1999 |
| FR | 2 715 440 | 7/1995 |
| FR | 2 767 358 | 2/1999 |
| WO | 99 47802 | 9/1999 |

* cited by examiner

*Primary Examiner*—Tony M. Argenbright
(74) *Attorney, Agent, or Firm*—Olbon, Spivak, McClelland, Maier & Neustadt, P.C.

(57) ABSTRACT

The injectors (**6*i*) allocated to the cylinders are supplied with fuel by a common injection train and their opening time is calculated and controlled by a computer. According to the invention, a) any possible overlap in the opening time of at least two injectors (6*i***) is detected, b) in the absence of an overlap, the fuel pressure in the train outside the opening time of the injector concerned is determined, c) if an overlap is present, the pressure of the fuel when the injector concerned is opened is determined and d) the measurement established is corrected according to a predetermined variation in the pressure of the fuel caused by the injector(s) opening.

6 Claims, 1 Drawing Sheet

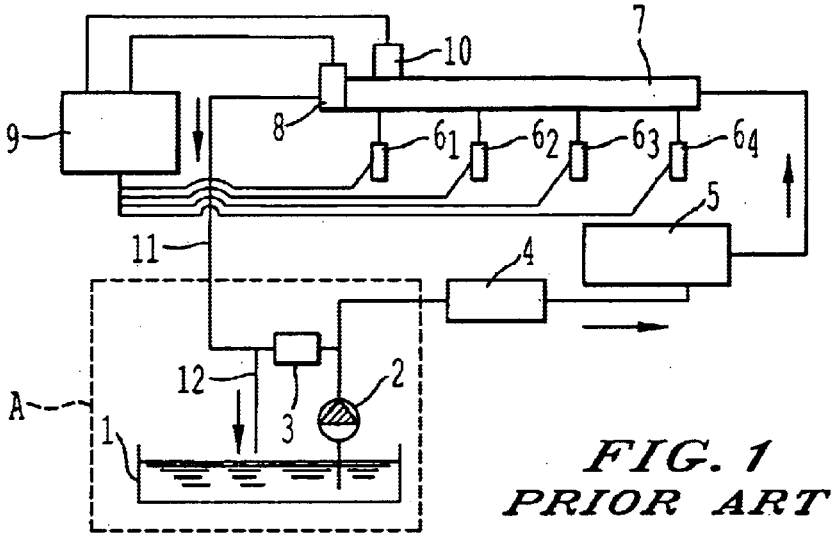
FIG. 1
PRIOR ART
FIG. 2
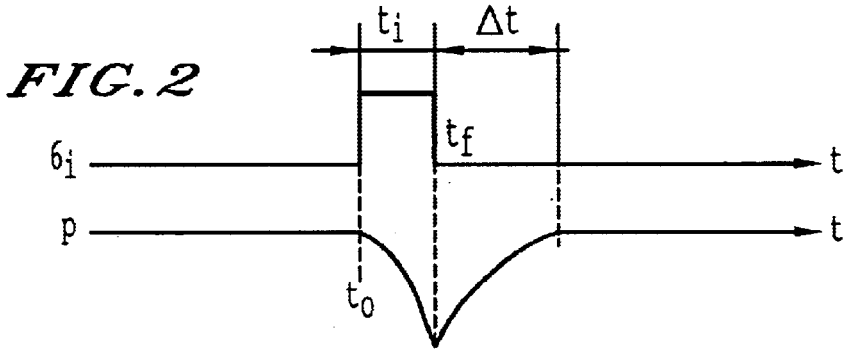
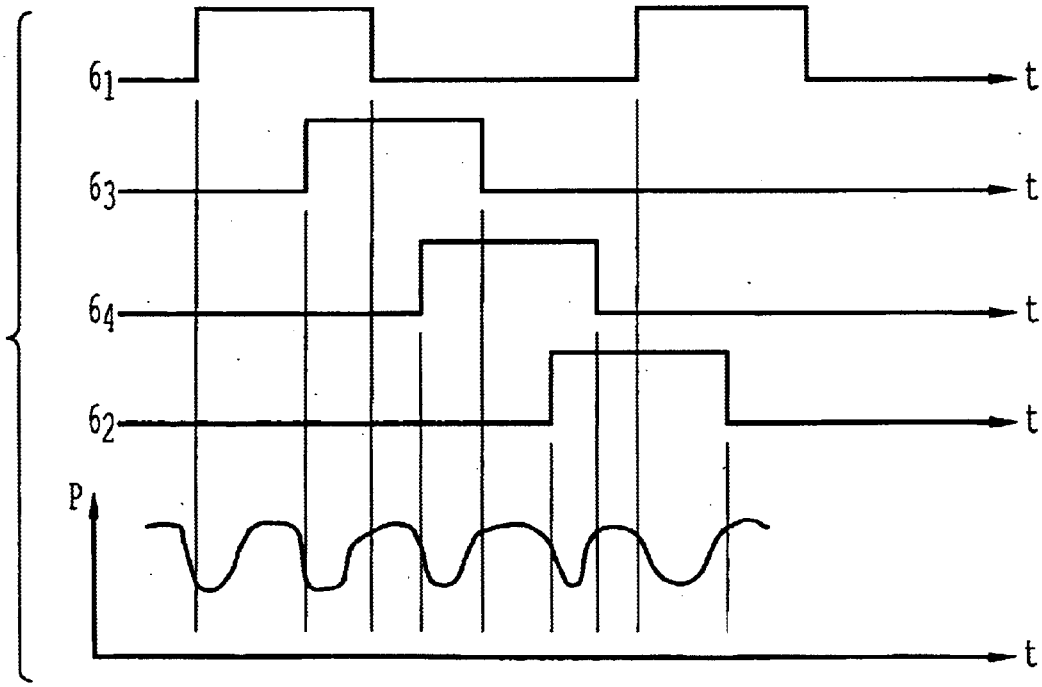
FIG. 3

METHOD FOR MEASURING THE FUEL PRESSURE IN AN INJECTION TRAIN OF AN INTERNAL COMBUSTION ENGINE

The present invention relates to a method for measuring the fuel pressure prevailing in an electromagnetic injector of this fuel in one of the cylinders of a direct-injection internal combustion engine, the injectors associated with the said cylinders being supplied with fuel via a common supply manifold and their open times being calculated and controlled by a computer.

In FIG. 1 of the attached drawing there is illustrated a known type of fuel-supply device of a direct-injection internal combustion engine comprising a fuel tank 1, a pump 2 supplied by tank 1 and associated with a pressure regulator 3 for delivery of the fuel to a second pump 5 via a filter 4, the fuel delivered by pump 2 being brought to a first pressure level that is higher than atmospheric pressure but is relatively low, so that pump 2 is referred to as the "low-pressure pump". Second pump 5 raises the fuel pressure once again to a second level higher than the first, suitable for supplying fuel injectors $\mathbf{6}_1$, $\mathbf{6}_2$, $\mathbf{6}_3$, $\mathbf{6}_4$ mounted on a fuel-supply manifold 7 of the cylinders of a direct-injection internal combustion engine (not illustrated).

The pressure of the fuel delivered by pump 5, referred to as the "high pressure pump", is fixed by an electromagnetic regulator 8, such as an electric valve controlled by a computer 9. In this latter case, a sensor 10 delivers to computer 9 a signal representative of the pressure of the fuel contained in manifold 7, to permit the computer to ensure regulation of the fuel pressure in this manifold at the required predetermined level. Computer 9 is commonly composed of the operational management computer of the engine, which among other tasks controls injectors $\mathbf{6}_i$ (i=1 to 4 in the illustrated example), and especially the open time thereof.

The fuel not delivered by injectors $\mathbf{6}_i$ is returned to the tank via a conduit 11, 12 maintained at atmospheric pressure.

The quantity of fuel that must be injected by a particular injector into the associated cylinder of the engine is calculated by computer 9 as a function of a certain number of well known parameters. The computer also determines which open time of the injector is appropriate for ensuring that a predetermined quantity of fuel will enter the cylinder. This open time is a function not only of this quantity but also of the fuel pressure that prevails in manifold 7 and that fluctuates in time despite the presence of regulator 8.

As seen hereinabove, this can be composed of an electric valve controlled by computer 9, to establish a discontinuous escape of fuel appropriate to ensure regulation of the fuel pressure at a predetermined level.

Whenever one of injectors $\mathbf{6}_i$ opens to introduce fuel into the associated cylinder, this opening action creates in manifold 7 a second escape of fuel, the consequences of which are illustrated in FIG. 2. In this figure, $\mathbf{6}_i$ represents the timing diagram for opening of injector $\mathbf{6}_i$ under consideration for a time $T_i$, and P represents the graph of the pressure P of fuel in the manifold as observed during and around the opening of this injector. As illustrated, after the moment $t_0$ of opening of the injector, the pressure P in the manifold drops because of the resulting escape of fuel, and this possibly continues until the moment $t_f=t_0+T_i$ at which the injector is closed, the pressure being restored to its previous stable level only after an additional time interval.

To allow for this pressure drop, it is proposed in French Patent No. 2715440 of the Applicant that the pressure prevailing in a fuel injector during the open time thereof be measured continuously in such a way that the computer can deduce therefrom, by integration, the quantity of fuel actually injected into the cylinders during this open time of the injector, and that the injector be signaled to close when the quantity of fuel to be introduced has been reached.

This method requires, however, that the fuel pressure in the manifold be measured continuously or at least that this measurement be performed with very high sampling frequency, compatible with the very short open time of the injectors (several ms).

In addition, the opening of an electromagnetic injector requires an electric current of high intensity, which generates strong electromagnetic perturbations that can falsify the measured signal transmitted by pressure sensor 10 during this opening action.

The objective of the present invention is to provide a method capable of measuring with good precision the fuel pressure prevailing in an injector of this fuel in a direct-injection internal combustion engine, this method not suffering from the disadvantages of the prior art technique indicated hereinabove.

In particular, the objective of the present invention is to provide such a method that permits pressure measurement at common sampling frequency while being insensitive to the electromagnetic perturbations prevailing in the surroundings of the pressure sensor used.

This objective as well as other objectives of the invention that will become evident upon reading the description hereinafter is achieved with a method for measuring the fuel pressure prevailing in an electromagnetic injector of this fuel in one of the cylinders of a direct-injection internal combustion engine, the injectors associated with the said cylinders being supplied with fuel via a common supply manifold and their open times being calculated and controlled by a computer, this method being noteworthy in that a) any overlap of the open times of at least two of the said injectors is detected, b) in the absence of such overlap, the fuel pressure in the manifold outside the open time of the injector under consideration is recorded, c) in the presence of such overlap the fuel pressure upon opening of the injector under consideration is recorded, and d) the recorded measurement is corrected as a function of a predetermined variation of fuel pressure induced by the opening of the injector or injectors.

As will be seen in detail hereinafter, this method makes it possible, on the basis of a pressure measurement that is reliable, since it is not perturbed, to know precisely the mean pressure prevailing in a fuel injector while this is delivering fuel. It is then possible precisely to adjust the open time of the injector to a value appropriate for it to deliver a quantity of fuel determined by the computer.

According to another characteristic of the method according to the invention, there is applied to the recorded measurement, in stage d) hereinabove, a decrement that is a function of the measured pressure and/or of an estimate of the open time of the injector.

According to another characteristic of this method, when it is used for calculation of the open time of the injectors of the engine, there is applied to the open time calculated on the basis of the recorded pressure an increment that is a function of the calculated open time and of the recorded fuel pressure.

Other characteristics and advantages of the present invention will become evident upon reading the description hereinafter and upon examining the attached drawing, wherein:

FIG. 1 is a diagram of a fuel-supply device of a direct-injection internal combustion engine, described in the introduction of the present description and appropriate for use of the method according to the invention, and FIGS. 2 and 3 are graphs illustrating this method.

Purely as an illustrative and non-limitative example, the invention will be described with respect to its use for control of a direct-injection internal combustion engine having four cylinders supplied respectively by injectors $6_1$, $6_2$, $6_3$, $6_4$.

According to the present invention, there are distinguished two situations depending on whether, during the opening of one of these injectors, this alone is open or, on the other hand, at least one of the other injectors is also open.

The first situation is illustrated in FIG. 2, which has already been partly described in the introduction of the present description, and it is encountered in particular when the engine speed is low or intermediate and the load on the engine is light or moderate. The injection time $T_i$ is then short and the fuel pressure, which decreases to its low value upon opening of the injector, cannot be reestablished before the injector is closed under the action of regulator 8.

As seen hereinabove, sensor 10 delivers to computer 9 an electric signal containing a measurement of the fuel pressure in manifold 7. However, during the opening of injector $6_i$ under consideration, usually controlled by passage of a high current through an electric coil, the resulting strong electromagnetic field is capable of perturbing the relatively weak electric signal transmitted by the sensor and thus of falsifying the pressure measurement used by computer 9 to adjust the open time $T_i$ of the injector as a function of a predetermined quantity of fuel to be injected into the associated cylinder of the engine, this quantity obviously being a function of the fuel pressure and of this open time.

According to the present invention, this disadvantage is overcome by disregarding, in the evaluation of fuel pressure, the measurements falsified in this way, and by continuing this evaluation after correction of a reliable measurement.

More precisely, since the pressure sensor delivers a measurement of the pressure sampled with an appropriate period, such as 4 ms, which is compatible with the precision to be achieved in adjustment of the open time of the injectors, computer 9 eliminates from its calculations the samples of pressure measurement recorded during the open time $T_i$ of the injector. Preferably there are also eliminated the samples recorded immediately after closing of the injector, during a sufficient additional time interval Ät for sensor 10 once again to deliver samples of unperturbed and restabilized pressure.

The pressure to be taken into account is then calculated by computer 9 on the basis of a pressure sample that is acquired, for example, prior to the moment $t_0$ of opening of the injector, and is corrected by appropriately decrementing the value thus acquired to allow for the fact that, during the open time $T_i$ of the injector, the mean fuel pressure is lowered compared with the pressure measured prior to opening of the injector. The magnitude of the decrement to be applied to the measurement can be evaluated by bench measurements. It is a function in particular of the level of pressure P measured prior to the opening action and/or of an estimate of the open time of the injector, such an estimate being obtained, for example, by calculating a base open time at the setpoint pressure applied to regulator 8.

When the engine is turning at high speed and/or is under heavy load, it is possible for several open times of injectors $6_i$ of the engine to overlap, as illustrated in FIG. 3, which represents the timing diagrams of opening of these injectors and the resulting variation of the fuel pressure P in manifold 7.

In this case, each of the successive opening actions of the various injectors causes this pressure to drop, after which it tends to rise again under the action of regulator 8, only to drop once again upon the subsequent opening of an injector. In practice, however, it has been observed that at most two injectors are open simultaneously at any moment, thus limiting the cumulative effect of pressure perturbations caused by their successive opening actions.

Computer 9 easily detects an overlapping open situation of at least two injectors by comparing the duration between two successive top dead points (TDP), which is known from the engine speed, with the open time of the corresponding injector. When this open time is longer than the duration of the interval between two TDPs, computer 9 diagnoses overlapping of the open times of at least two of the injectors.

It is then no longer possible to exclude the fuel-pressure samples transmitted during the open time of the injectors.

According to the present invention, computer 9 imposes, in this situation, for measurement of the fuel pressure in an injector, sampling of this measurement synchronized with the opening of the said injector, whether this opening action occurs alone or during the open time of another injector, and it corrects the selected sample by decrementing it to allow for the mean fuel-pressure drop resulting from opening of the injector under consideration.

It has been found in fact that it is upon opening of the injector that the sample of the delivered pressure is the least perturbed and therefore can most accurately approximate, after being appropriately decremented, the mean pressure in the injector under consideration during the opening thereof.

Since computer 9 consequently knows this mean pressure under all circumstances, it can appropriately adjust the open time $T_i$ of each injector by signaling the moment at which it is closed.

Instead of decrementing the pressure derived from a sample of pressure measurement selected as indicated hereinabove for calculation of this mean pressure and then the open time of the injector, computer 7 can calculate this open time directly by applying, to an open time $T_i$ calculated on the basis of the recorded pressure, an increment $ÄT_i$ that is a function of the calculated open time and of the recorded pressure, this increment compensating for the pressure drop observed in the injector following opening thereof.

It now appears that the invention indeed makes it possible to achieve the announced object, that is, to ensure precise control of the open time of the injectors on the basis of recording of an unperturbed sample of the fuel pressure and of an appropriate correction to the said sample.

What is claimed is:

1. A method for measuring the fuel pressure prevailing in an electromagnetic injector ($6_i$) of this fuel in one of the cylinders of a direct-injection internal combustion engine, the injectors ($6_i$) associated with the said cylinders being supplied with fuel via a common supply manifold (7) and their open times ($T_i$) being calculated and controlled by a computer (9), characterized in that:

a) any overlap of the open times of at least two of the said injectors ($6_i$) is detected, b) in the absence of such overlap, the fuel pressure in the manifold (7) outside the open time of the injector under consideration is recorded, c) in the presence of such overlap the fuel pressure upon opening of the injector under consideration is recorded, and d) the recorded measurement is corrected as a function of a predetermined variation of fuel pressure induced by the opening of the injector or injectors ($6_i$).

2. A process according to claim 1, characterized in that, in stage d), there is applied to the recorded measurement a decrement that is a function of the measured pressure and/or of an estimate of the open time ($T_i$).

3. A process according to claim 1, applied to calculation of the open time ($T_i$) of the injectors of the engine, characterized in that there is applied to the open time ($T_i$) calculated on the basis of the recorded pressure an increment ($\ddot{A}T_i$) that is a function of the calculated open time and of the recorded fuel pressure.

4. A process according to claim 1, characterized in that, in stage b), the fuel pressure is recorded by selecting a sample of the measurement of this pressure chosen from among a succession of such samples, the samples taken during the open time of the injectors being eliminated.

5. A process according to claim 4, characterized in that the sampling period is approximately 4 to 10 ms.

6. A process according to claim 1, characterized in that, in stage c), there is imposed sampling synchronized with the signal to open the injector.

* * * * *

UNITED STATES PATENT AND TRADEMARK OFFICE

CERTIFICATE OF CORRECTION

PATENT NO. : 6,705,295 B1
DATED : March 16, 2004
INVENTOR(S) : Tarroux et al.

It is certified that error appears in the above-identified patent and that said Letters Patent is hereby corrected as shown below:

Title page,
Item [73], Assignee, should read:
-- [73] Assignees: Renault, Boulogne Billancourt (FR);
Siemens Automotive S.A., Toulouse (FR) --

Signed and Sealed this

Thirty-first Day of May, 2005

JON W. DUDAS
*Director of the United States Patent and Trademark Office*